US005924137A

United States Patent [19]

Gold

[11] Patent Number: 5,924,137

[45] Date of Patent: Jul. 20, 1999

[54] FINGER END PROTECTION CONSTRUCTION

[76] Inventor: Danny Gold, 27 Barker Road, Apt. E-2, Hong Kong, The Hong Kong Special Administrative Region of the People's Republic of China

[21] Appl. No.: 08/751,115

[22] Filed: Nov. 15, 1996

[51] Int. Cl.[6] ..... A41D 19/00

[52] U.S. Cl. ..... 2/161.1; 2/159

[58] Field of Search ..... 2/161.1, 159, 161.6, 2/161.5, 163, 169

[56] References Cited

U.S. PATENT DOCUMENTS

| | | | |
|---|---|---|---|
| 1,074,351 | 9/1913 | Carson | 2/163 |
| 4,071,913 | 2/1978 | Rector | 2/161.1 |
| 4,507,807 | 4/1985 | Karkanen | 2/163 |
| 4,654,896 | 4/1987 | Rinehart | 2/163 |

*Primary Examiner*—Gloria Hale

*Attorney, Agent, or Firm*—Aufrichtig Stein & Aufrichtig, P.C.

[57] ABSTRACT

A protective snowboard glove having a top panel, a bottom panel and a plurality of side panels and fourchettes. A coupling structure secures the side panels and fourchettes between the top panel and the bottom panel around a series of seams, forming a glove having a series of finger sections and a thumb section. Each of the finger sections has a tip region formed of a portion of the top panel forming the back of the fingertip, a portion of the bottom panel forming the palm side of the fingertip and a side panel or fourchette on each side of the tip region forming the sides of the tip region. The series of seams includes at least a top seam, connecting the top panel to the side panel or fourchette on each side of the tip region and a bottom seam and connecting the bottom panel to the side panel or fourchette on each side of the tip region. A protective covering, coupled to each of the tip regions of the finger sections covers and prevents wear to the palm sides of the fingertips and the bottom seams of the fingertips.

6 Claims, 2 Drawing Sheets

FINGER END PROTECTION CONSTRUCTION

BACKGROUND OF THE INVENTION

The invention is generally directed to a finger end protection construction and in particular to a finger end construction for snowboard gloves.

As the sport of skiing developed, ski glove technology developed along with it to produce improved gloves and mittens for the specialized use in connection with the skiing. The gloves developed layers of insulation, waterproof treatable membranes, heater packs to heat the insides of the gloves as well as closure mechanisms for opening and sealing the gauntlet or open end of the glove on the wearer's hand. In addition, as glove technology developed it became readily apparent that a comfortable ski glove should be pre-curved so that the glove would conform to a person's, at rest, partially curled hand posture. In connection with the pre-curvature of gloves certain constructions were indicated and others found wanting. In particular, the gunn cut construction, which puts seams at the backs of the fingers, which is often used in work gloves, is not practical in making a pre-curved glove period. The better methods are to use a sidewall construction which allows the best control of the preshaping. However, there are more exposed seams than in the gunn cut construction.

As skiing developed, the sport of snowboarding, which is a cross between skiing and surf boarding has blossomed and become more popular. When snowboarding, one maintains one's balance in turn by bending one's knees and resting one or more of the fingertips on the snow to provide balance and aid in improving the turning radius. This style of snowboarding is, obviously, tougher on the surfaces of the gloves being utilized than traditional skiing. In traditional skiing the skier wears gloves primarily to keep the hands warm and to grip a ski pole in each hand. The gloves need to have sufficient flexibility to grip the ski pole and provide limited manual dexterity for other activities. Thus, the surface characteristics of the ski gloves are not as rigorous as for snowboarding.

In snowboarding there have been several approaches used to toughen the surfaces and the seams of the gloves designed for this sport. One approach has been to make the finger tip regions out of stronger materials such as Kevlar® or heavy leathers. However, this still leaves the seams exposed to wear and tends to unduly restrict the flexibility of the gloves. Welting has been also added to reinforce the seams, but this again is only partially successful and limits the flexibility of the gloves. Other approaches have been to apply rubber tips to the finger ends. These are uncomfortable and thus not useful.

Accordingly, there is a need for an improved construction which reinforces the finger tips and seams of a snowboarding glove so that the glove wears adequately without restricting the flexibility of the glove.

SUMMARY OF THE INVENTION

The invention is generally directed to a reinforcement for the protection of finger ends in connection with snowboarding gloves in which the palm and end of the fingers are covered with a flexible leather member designed to adapt the shape to the finger tip region and prevent undue wear of the finger tips and seams at the finger tip without restricting the flexibility of the glove.

Accordingly, it is an object of the invention to provide an improved finger tip protection for a snowboarding glove.

Still another object of the invention is to provide an improved finger tip protection for the finger tips and seams at the ends of a snowboarding glove so that upon repeated contact of the snowboarder's hands with the snow the glove does not unduly wear.

Another object of the invention is to provide a method of protecting the finger tips of snowboard gloves with conventional glove material.

Still another object of the invention is to provide an improved method of protecting the finger tips of a glove by stitching an applique to the finger tip regions.

Yet another further object of the invention is to provide an improved protection system protecting a snowboarding glove from abrasive damage due to repeated contact with the snow or ice during snowboarding.

Yet another further object of the invention is to provide an improved finger tip and finger tip seam protector for protecting the palm portion of the finger tips without interfering with the flexibility of the glove and utilizing conventional glove materials.

Still other objects and advantages of the invention will in part be obvious and will in part be apparent from the specification.

The invention accordingly comprises the features of construction, combinations of elements and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
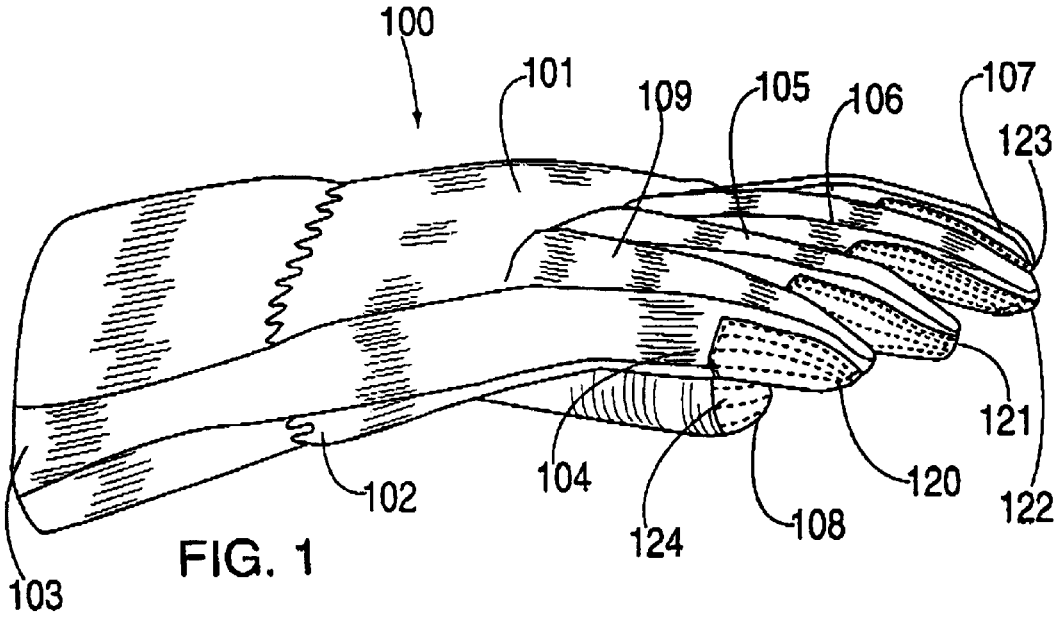
FIG. 1 is a prospective view of a snowboarding glove constructed in accordance with a preferred embodiment of the invention.

Reference is first made to FIG. 1 wherein a snowboard glove, generally indicated as 100, constructed in accordance with the preferred embodiment of the invention is depicted. Snowboard glove 100 includes a top or back panel 101, a bottom or palm panel 102 and a side panel 103. Glove 100 also includes finger portions 104, 105, 106, 107 and thumb portion 108. Finally, glove 100 includes finger tip protectors 120, 121, 122 and 123 and thumb tip protector 124.

Figure 4:
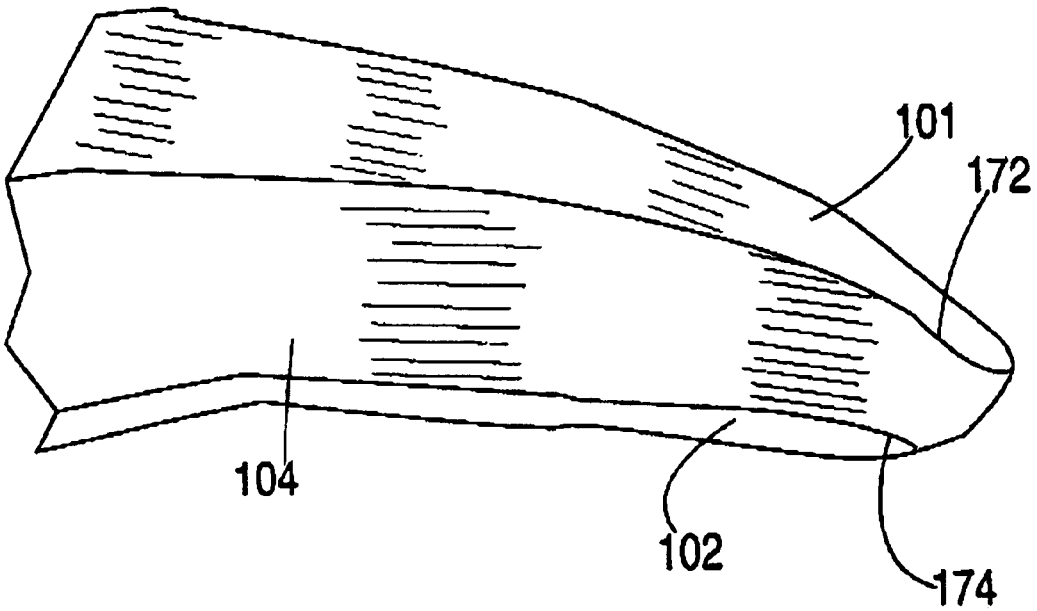
FIG. 4 is a cut away and enlarged view of a finger of a snowboard glove constructed in accordance with a preferred embodiment of the invention prior to attachment of the finger tip protective member.

The glove 100 is constructed as a pre-curved glove with side panel 103 is made up of a portion along the side of the hand forming a finger side portion 109. The glove 100 is formed generally in what is known as a box fingered end in which four panels meet at the finger tip, the two side panels of the finger (also known as fourchettes where they appear between the fingers, rather than on the heel of the hand or at the thumb side of the index finger) and the top and bottom panels 101, 102. This construction can be best seen in FIG. 4 in which the pinky of the glove of FIG. 1 is shown without finger tip protector 120.

The various panels of the glove 100 are sewn together utilizing seams at various points to connect the panels. Again with reference to FIG. 4, side panel 103 is pre-curved panel. Top panel 101 is secured to side panel 103 with a side seam 172 which extends around top panel 101, also securing top panel 101 to the fourchette (not shown) forming the inner surface of pinky finger portion 104. Likewise, seam 174 connects lower panel 102 to side panel 103 and the corresponding fourchette (not shown) on the other side of finger 103. Finally, there is a seam (not shown) at the tip of the finger between top panel 101 and bottom panel 102 connecting side panel 103 and the adjacent fourchette (not shown). In some embodiments there is no seam at the tip of the finger. Rather, the seam between fourchettes is at the crotch between fingers.

Figure 2:
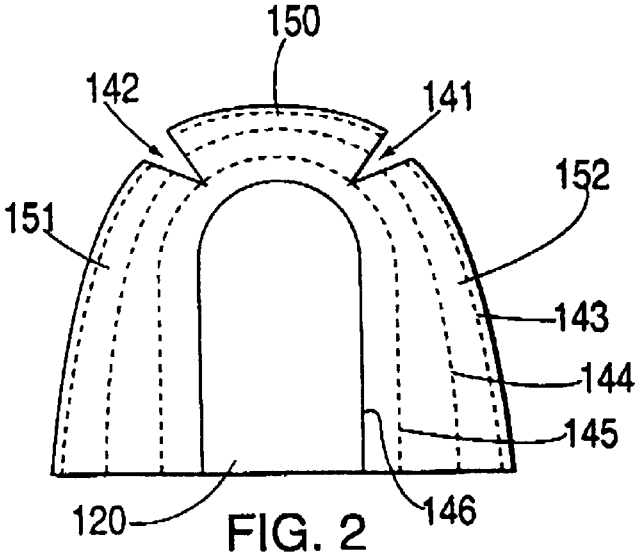
FIG. 2 is a top plan view of a finger tip protective member.

Reference is next made to FIG. 2 wherein a finger tip protector generally indicated as 120 constructed in accordance with a preferred embodiment of the invention is depicted. Finger tip protector 120 is formed with a flat base surface and a generally rounded upper surface. Protector 120 is formed with two angled cut-outs 141 and 142 which generally divide the finger tip protector 120 into a top central region 150 and side regions 151 and 152. Markings 143, 144, 145 and 146 are drawn to aid the sewing machine operator in fixing the finger tip protector 120 to finger section 104. The lines are used to mark the locations of the seams.

Figure 3:
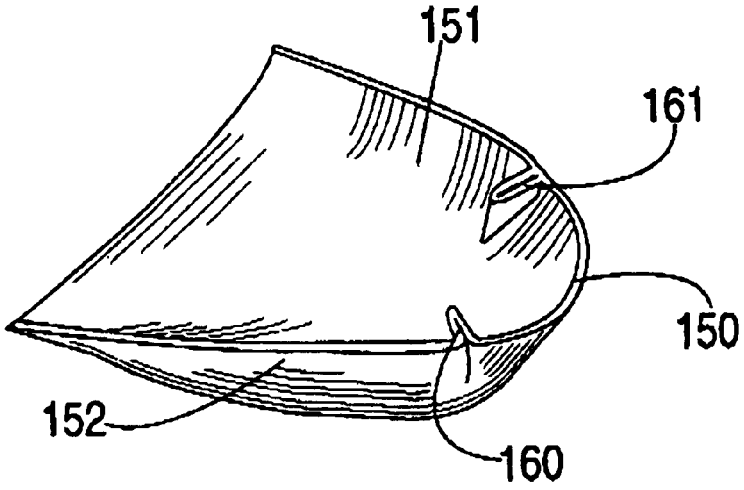
FIG. 3 is a prospective view of a finger tip protective member in an assembled state.

Reference is next made to FIG. 3 wherein the pre-assembled finger tip protector 120 is shown. The sides of cut-outs 141 and 142 are sewn to each other along seams 160 and 161 which have the effect of connecting sections 150, 151 and 152 into a generally curved, three dimensional cap shape which is adapted to fit over the lower portion of finger 104. Similarly, finger tip protectors 121, 122 and 123 and thumb protector 124 are formed and then attached.

When the pre-assembled finger tip protector 120, shown in FIG. 3, is placed in its appropriate position it is then sewn onto finger 104 in the position shown in FIG. 1. The sewing machine operator generally attaches finger tip protector 120 along the line 146 which corresponds with the bottom panel 102 of glove 100 and along lines 143, 144 and 145 to provide a secure coupling. The finger tip protector 120 in position covers side seams 172 and 174, the finger tip tip seam (not shown) and a portion of side panel seam 170. In this way, wear on these seams, and in particularly on the tip portions of seams 172, 174 and the central tip seam, which are stressed during snowboarding, is prevented.

In a preferred embodiment, the finger tip protectors are formed of a pliable natural or artificial leather material. It is sized so as to cover the palm side of the fingers, a portion of the side and the lower portion of the tips of the fingers. In this way, when a snowboarder places an open hand palm side down against the snow, the finger tip protectors 120–124 come in contact with the snow. The underlying seams which hold the glove together and provide the structural stability to the glove are protected from wear. In this way, better protection is provided to the finger tip region seams. The finger tip protectors do not inhibit the flexibility of the gloves and allow the gloves to be constructed in normal fashion prior to attachment of the finger tip protectors. Also, the finger tip protectors can be made of conventional soft and flexible glove materials rather than requiring expensive, exotic materials for the glove materials. Also, the special techniques utilized to strengthen or seal the seams previously utilized are not required.

Also, the finger tip protectors provide a more stable base for the snowboarder's placement of the fingers on the ice, in a sense providing a target for the hand's contact with the snow. Other types of glove construction in which seams are present at the stress points of the contact with the ice or other contact surface can be similarly protected with the pre-curved capped protectors. While the finger tip protectors herein are shown as being sewn to the gloves, they may also be secured by suitable adhesives.

In addition, the protective tip also has application to constructions without box finger sidewalls. This is somewhat more complicated, but can be done with specialized machinery, such as a "P.K." sewing machine for a non-fourchette glove. The tip is stitched onto the back of the fingers with a P.K. machine. This is a sewing machine which allows the sewing machine operator to stitch in very confined places. The P.K. sewing machine is a post machine. The looper thread (it is a chain stitch machine and has no bobbin) rises through the post which is very narrow (e.g. about 8 mm in diameter). The machine was made originally to sew gloves with a flat (lap) seam where the operator could sew into the finger of a glove.

Accordingly, an improved glove or mitten construction in which pre-formed protective finger tip protectors are attached to the finger tips' frictional points to prevent rapid wear of the seams on the finger tip in snowboarding and other similar sporting endeavors is provided.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. A protective snowboard glove, comprising:

a top panel;

a bottom panel;

a plurality of side panels and fourchettes;

coupling means, securing the side panels and fourchettes between the top panel and the bottom panel around a series of seams, forming a glove having a series of finger sections and a thumb section, each of the finger sections having a tip region formed of a portion of the top panel forming the back of the fingertip, a portion of the bottom panel forming the palm side of the fingertip and a side panel or fourchette on each side of the tip region forming the sides of the tip region, the series of seams including at least a top seam, connecting the top panel to the side panel or fourchette on each side of the tip region and a bottom seam, connecting the bottom panel to the side panel or fourchette on each side of the tip region;

protective means coupled to each of the tip regions of the finger sections for covering and preventing wear to the palm sides of the fingertips and the bottom seams of the fingertips.

2. The protective snowboard glove of claim 1 wherein the protective means is formed as a series of flat, flexible members adapted to be assembled into curved caps sized to fit over the tips of each of the fingers.

3. The protective snowboard glove of claim 2 wherein the flat flexible members have cutout regions for gathering into the curved cap shapes.

4. The protective snowboard glove of claim 3 wherein the flat flexible members are stitched across the cutout regions.

5. The protective snowboard glove of claim 1 wherein the protective means is formed of glove leather and stitched to the fingertips.

6. The protective snowboard glove of claim 1 wherein the glove further includes tip seams at the tip region of the finger tips connecting a fourchette to another fourchette or a side wall and the protective means covers the tip seams.

* * * * *